US007677919B1

(12) United States Patent
Lin

(10) Patent No.: US 7,677,919 B1
(45) Date of Patent: Mar. 16, 2010

(54) BATTERY CONNECTOR

(75) Inventor: Le-Yao Lin, Taipei Hsien (TW)

(73) Assignee: Tai Twun Enterprise Co., Ltd., Taipei Hsien (TW)

( * ) Notice: Subject to any disclaimer, the term of this patent is extended or adjusted under 35 U.S.C. 154(b) by 0 days.

(21) Appl. No.: 12/367,582

(22) Filed: Feb. 9, 2009

(51) Int. Cl.
*H01R 3/00* (2006.01)

(52) U.S. Cl. ..... 439/500; 439/682; 439/660

(58) Field of Classification Search ..... 439/500, 439/682, 660, 83
See application file for complete search history.

(56) References Cited

U.S. PATENT DOCUMENTS 6,229,101 B1 * 5/2001 Sekiya et al. ..... 174/266
6,869,294 B2 * 3/2005 Clark et al. ..... 439/79
2004/0023562 A1 * 2/2004 Barry et al. ..... 439/660
2009/0142953 A1 * 6/2009 Patel et al. ..... 439/345

* cited by examiner

*Primary Examiner*—Tho D Ta
(74) *Attorney, Agent, or Firm*—Alan Kamrath; Kamrath & Associates PA

(57) ABSTRACT

A battery connector includes an insulating frame having a plurality of parallel partitioning boards spaced from each other in a direction, with a positioning slot defined between two of the partitioning boards adjacent to each other. A pair of terminals is received in each positioning slot. Each pair of terminals includes a first terminal and a second terminal. Each of the first and second terminals includes a body having a first end and a second end. A welding portion extends from the second end. A bend is formed between the body and the welding portion. The first end includes a resilient contact portion having a contact end. The contact ends of each pair of terminals together define a coupling space for coupling with one of a plurality of contact blades of a connector.

4 Claims, 4 Drawing Sheets

BATTERY CONNECTOR

BACKGROUND OF THE INVENTION

The present invention relates to a battery connector and, more particularly, to a battery connector with reliable positioning effect for retaining terminals in place.

Electronic devices are widely used and generally include a battery to supply power and a battery connector to which the battery is coupled. A typical battery connector includes an insulating body having a plurality of slots each receiving a terminal in the form of a plate. Each terminal includes an outwardly extending contact portion for contacting one of a plurality of contact blades of a plug. When the terminals are mounted in the slots that are wider than the terminals, the terminals can move in the slots. When the terminals are coupled with the contact blades of the plug, the contact is poor, for each terminal engages one of the contact blades with only one side and, thus, provides a small engaging coupling force. Furthermore, the contact portion of each terminal is liable to deform by a force imparted by the contact blade of the plug.

To overcome the above disadvantages, double-sided terminals have been proposed. However, these terminals are integrally formed of metal, leading to high manufacturing costs. Furthermore, the whole connector must be replaced when only one side of a terminal deforms permanently.

Thus, a need exists for an inexpensive battery connector with reliable coupling effect.

BRIEF SUMMARY OF THE INVENTION

The present invention solves this need and other problems in the field of battery connectors by providing, in a preferred form, a battery connector including an insulating frame having a plurality of parallel partitioning boards spaced from each other in a direction, with a positioning slot defined between two of the partitioning boards adjacent to each other. The battery connector further includes a plurality of pairs of terminals. Each pair of terminals includes a first terminal and a second terminal. Each of the first and second terminals includes a body having a first end and a second end. A welding portion extends from the second end. A bend is formed between the body and the welding portion. The first end includes a resilient contact portion having a contact end. The contact ends of each pair of terminals together define a coupling space adapted for coupling with one of a plurality of contact blades of a connector. Each pair of terminals is received in one of the positioning slots with the welding portions outside of the partitioning slots.

In the most preferred form, the insulating frame further includes first and second positioning boards in each positioning slot. The first and second positioning boards are spaced in the direction. The first positioning board and one of the partitioning boards define a first spacing securely receiving one of the first terminals. The second positioning board and another of the partitioning boards define a second spacing securely receiving one of the second terminals. The first and second positioning boards in each positioning slot define a third spacing adapted for receiving one of the contact blades of the connector.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

DETAILED DESCRIPTION OF THE INVENTION

Figure 1:
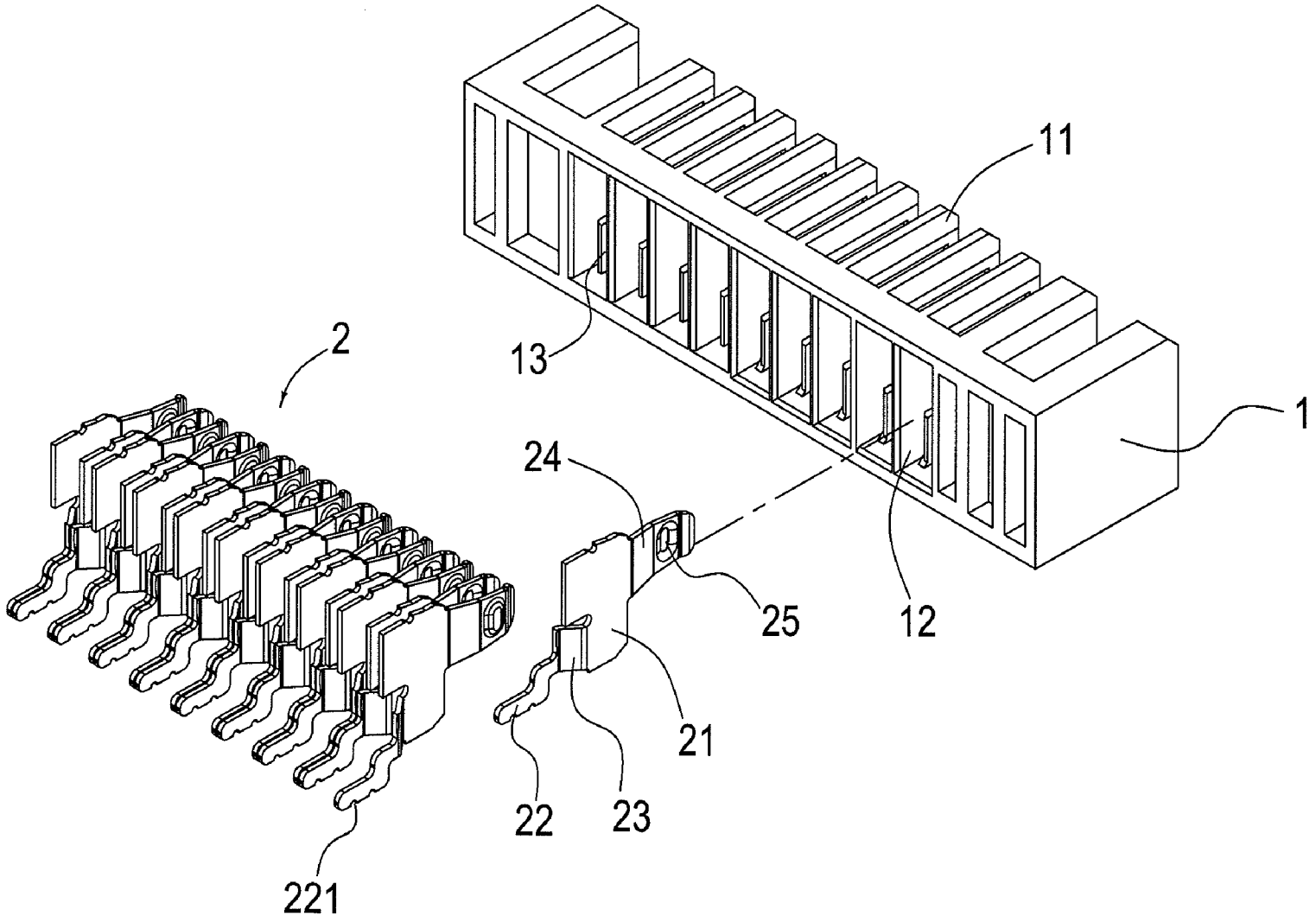
FIG. 1 shows an exploded, perspective view of a battery connector according to the preferred teachings of the present invention.
Figure 2:
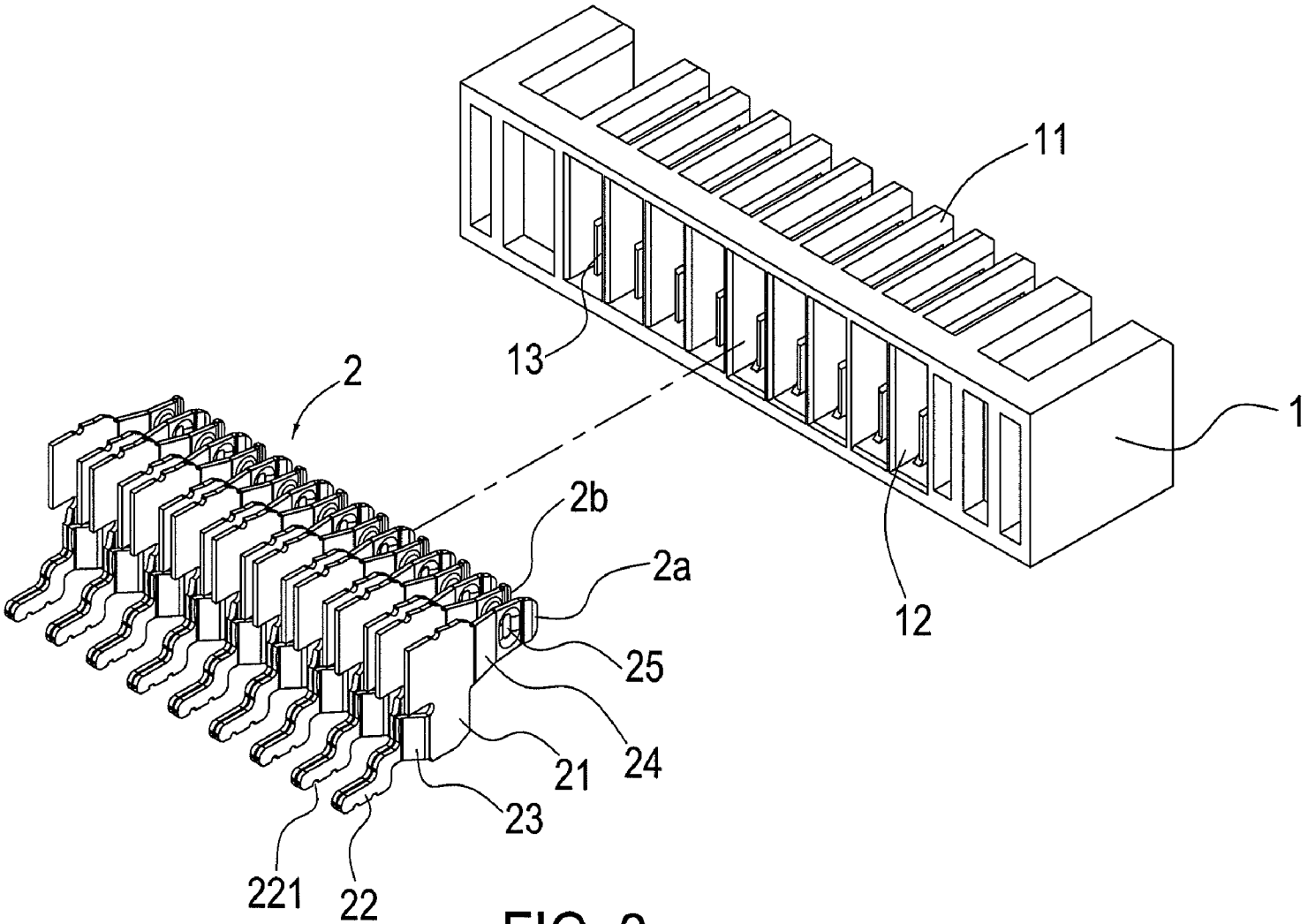
FIG. 2 shows another exploded, perspective view of the battery connector of FIG. 1.
Figure 3:
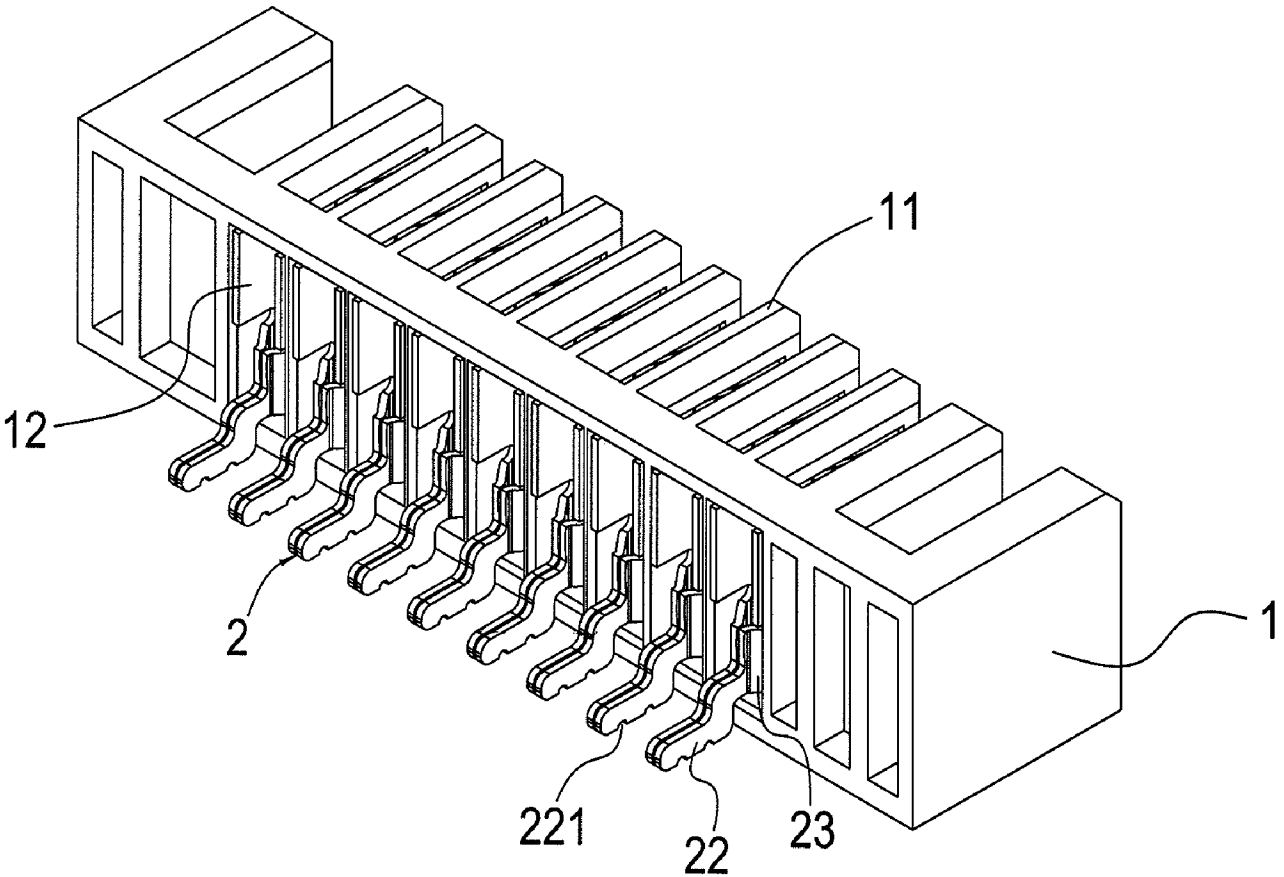
FIG. 3 shows a perspective view of the battery connector of FIG. 1.
Figure 4:
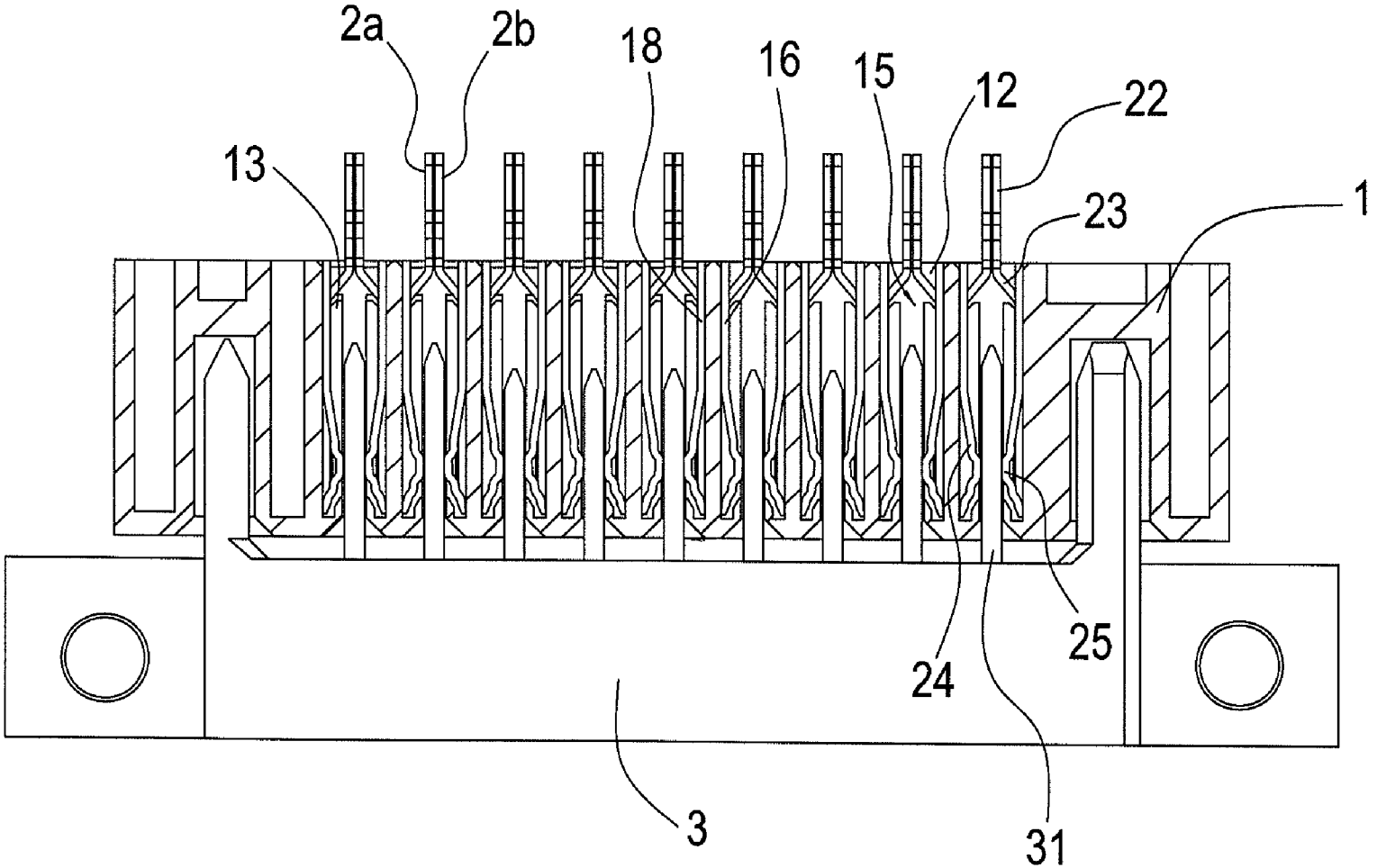
FIG. 4 shows a cross sectional view of the battery connector of FIG. 1 and a connector coupled with the battery connector.

A battery connector according to the preferred teachings of the present invention is shown in the drawings and generally includes an insulating frame 1 having a plurality of parallel partitioning boards 11 spaced from each other in a direction. A positioning slot 12 is defined between two of the partitioning boards 11 adjacent to each other.

The battery connector further includes a plurality of pairs of terminals 2. Each pair of terminals 2 includes a first terminal 2*a* and a second terminal 2*b*. Each of the first and second terminals 2*a*, 2*b* includes a body 21 having a first end and a second end. A welding portion 22 extends from the second end and includes at least one welding groove 221 for receiving welding flux to enhance welding stability. A bend 23 is formed between the body 2 and the welding portion 22. The bend 23 of each of the first and second terminals 2*a*, 2*b* extends from an end of the body 21. The first end of the body 21 includes a resilient contact portion 24 having a contact end 25. The contact end 25 of each of the first and second terminals 2*a* and 2*b* can have circular or elliptical cross sections. The resilient contact portions 24 of each pair of terminals 2*a* and 2*b* are received in one of the positioning slots 12 and extend towards but spaced from each other, with the contact ends 25 defining a coupling space for coupling with one of a plurality of contact blades 31 of a connector 3 in the preferred form shown as a plug. Each pair of terminals 2*a* and 2*b* is received in one of the positioning slots 12 with the welding portions 22 outside of the partitioning slots 12. When the connector 3 is coupled with the battery connector 2, the resilient contact portions 24 in the same positioning slot 12 are moved away from each other.

According to the preferred form shown, the insulating frame 21 further includes first and second positioning boards 13 in each positioning slot 12. The first and second positioning boards 13 are spaced in the direction. The first positioning board 13 and one of the partitioning boards 11 define a first spacing 16 securely receiving one of the first terminals 2*a*. The second positioning board 13 and another of the partitioning boards 11 define a second spacing 18 securely receiving one of the second terminals 2*b*. The first and second positioning boards 13 in each positioning slot 12 define a third spacing 15 for receiving one of the contact blades 31 of the connector 3.

When each pair of terminals 2 is received in one of the positioning slots 12, the body 21 of each of the first and second terminals 2*a* and 2*b* is guided and positioned by the first and second positioning boards 13. Due to provision of the bends 23, the welding portions 22 of the first and second terminals 2*a* and 2*b* extend toward a central axis of the positioning slot 13. The welding portions 22 of each pair of terminals 2 are welded to a circuit board.

When the connector 3 is coupled with the battery connector 2, each contact blade 31 of the connector 3 extends between and is in electric contact with the contact ends 25 of a pair of terminals 2. Furthermore, each contact blade 31 of the connector 3 extends into the coupling space between the contact ends 25 of a pair of terminals 2. Further, the resilient contact portions 24 of each pair of terminals 2 resiliently deform due to insertion of the contact blade 31, providing a clamping force to securely clamp the contact blade 31. Thus, each contact blade 31 is clamped at both sides to provide enhanced clamping effect. Furthermore, the manufacturing of the battery connector is simplified, and the costs are cut.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A battery connector as comprising:

an insulating frame including a plurality of parallel partitioning boards spaced from each other in a direction, with a positioning slot defined between two of the partitioning boards adjacent to each other; and a plurality of pairs of terminals, with each pair of the terminals including a first terminal and a second terminal, with each of the first and second terminals including a body having a first end and a second end, with a welding portion extending from the second end, with a bend formed between the body and the welding portion, with the first end including a resilient contact portion having a contact end, with the contact ends of each pair of the terminals together defining a coupling space adapted for coupling with one of a plurality of contact blades of a connector, and with each pair of the terminals being received in one of the plurality of positioning slots with the welding portions outside of the partitioning slots;

with the insulating frame further including first and second positioning boards in each of the plurality of positioning slots, with the first and second positioning boards spaced in the direction, with the first positioning board and one of the plurality of partitioning boards defining a first spacing securely receiving one of the first terminals, with the second positioning board and another of the plurality of partitioning boards defining a second spacing securely receiving one of the second terminals, and with the first and second positioning boards in each of the plurality of positioning slots defining a third spacing adapted for receiving one of the plurality of contact blades of the connector.

2. The battery connector as claimed in claim 1, with the welding portion of each of the first and second terminals including at least one welding groove.

3. The battery connector as claimed in claim 1, with the bend of each of the first and second terminals extending from an end of the body.

4. The battery connector as claimed in claim 1, with the contact end of each of the first and second terminals having circular or elliptical cross sections.

* * * * *